US010547109B2

(12) United States Patent
Andujar Linares et al.

(10) Patent No.: US 10,547,109 B2
(45) Date of Patent: Jan. 28, 2020

(54) WIRELESS DEVICE USING AN ARRAY OF GROUND PLANE BOOSTERS FOR MULTIBAND OPERATION

(71) Applicant: Fractus Antennas, S.L., Sant Cugat del Vallès, Barcelona (ES)

(72) Inventors: Aurora Andujar Linares, Barcelona (ES); Jaume Anguera Pros, Vinaros (ES)

(73) Assignee: Fractus Antennas, S.L., Sant Cugat del Vallès, Barcelona (ES)

( * ) Notice: Subject to any disclaimer, the term of this patent is extended or adjusted under 35 U.S.C. 154(b) by 0 days.

(21) Appl. No.: 16/180,441

(22) Filed: Nov. 5, 2018

(65) Prior Publication Data

US 2019/0260125 A1 Aug. 22, 2019

Related U.S. Application Data

(63) Continuation of application No. 15/081,467, filed on Mar. 25, 2016, now Pat. No. 10,224,631.
(Continued)

(30) Foreign Application Priority Data

Mar. 27, 2015 (EP) ..... 15161245

(51) Int. Cl.
*H01Q 5/335* (2015.01)
*H01Q 21/30* (2006.01)
(Continued)

(52) U.S. Cl.
CPC ..... *H01Q 5/335* (2015.01); *H01Q 1/24* (2013.01); *H01Q 1/243* (2013.01); *H01Q 1/36* (2013.01); *H01Q 21/28* (2013.01); *H01Q 21/30* (2013.01)

(58) Field of Classification Search
CPC ..... H01Q 5/335; H01Q 21/30; H01Q 1/24; H01Q 21/28; H01Q 1/36; H01Q 1/243
(Continued)

(56) References Cited

U.S. PATENT DOCUMENTS 6,762,723 B2 7/2004 Nallo et al.
6,819,287 B2 11/2004 Sullivan et al.
(Continued)

FOREIGN PATENT DOCUMENTS

CN 103155276 11/2015
EP 2978069 A1 1/2016
(Continued)

OTHER PUBLICATIONS

Andújar, Aurora, et al, Distributed systems robust to hand loading based on nonresonant elements, Microwave and optical technology letters, Oct. 2013, p. 2307-2317, vol. 55, No. 10, Wiley Periodicals Inc.

(Continued)

*Primary Examiner* — Hai V Tran
(74) *Attorney, Agent, or Firm* — Edell, Shapiro & Finnan, LLC

(57) ABSTRACT

A radiating system comprises a radiating structure including two or more radiation boosters for transmission and reception of electromagnetic wave signals, a radiofrequency system and an external port. The radiating system is capable of operation in at least a first and second frequency regions which are preferably separated. The radiofrequency system comprises two or more matching networks and a combining structure at which, in transmission, electromagnetic wave signals from the external port are substantially separated and coupled to each radiation booster based on the frequency of the signals; and, in reception, signals from each radiation booster are combined and coupled to the external port. The
(Continued)

radiofrequency system provides impedance matching to the radiating structure in the first and second frequency regions at the external port. An advantage of such radiating system is that signals from the first and second frequency regions are fed to and retrieved in one single port.

20 Claims, 6 Drawing Sheets

Related U.S. Application Data

(60) Provisional application No. 62/139,809, filed on Mar. 30, 2015.

(51) Int. Cl.
*H01Q 1/24* (2006.01)
*H01Q 21/28* (2006.01)
*H01Q 1/36* (2006.01)

(58) Field of Classification Search
USPC ..... 343/749
See application file for complete search history.

(56) References Cited

U.S. PATENT DOCUMENTS

| | | | |
|---|---|---|---|
| 7,176,845 | B2 | 2/2007 | Fabrega-Sanchez et al. |
| 7,274,340 | B2 | 9/2007 | Ozden et al. |
| 7,446,708 | B1 | 11/2008 | Nguyen et al. |
| 9,112,284 | B2 | 8/2015 | Andujar Linares et al. |
| 9,350,070 | B2 | 5/2016 | Anguera Pros et al. |
| 9,379,443 | B2 | 6/2016 | Anguera Pros et al. |
| 10,033,114 | B2 | 7/2018 | Anguera Pros et al. |
| 2003/0063036 | A1 | 4/2003 | Sato et al. |
| 2003/0174092 | A1 | 8/2003 | Sullivan et al. |
| 2004/0090372 | A1 | 5/2004 | Nallo et al. |
| 2006/0214856 | A1 | 9/2006 | Nakano et al. |
| 2007/0146212 | A1 | 6/2007 | Ozden et al. |
| 2009/0318094 | A1 | 12/2009 | Pros et al. |
| 2010/0176999 | A1 | 7/2010 | Anguera et al. |
| 2011/0117976 | A1 | 5/2011 | Nishikido et al. |
| 2013/0187825 | A1 | 7/2013 | Andujar Linares et al. |
| 2013/0342416 | A1 | 12/2013 | Andujar Linares et al. |
| 2014/0015728 | A1 | 1/2014 | Anguera Pros et al. |
| 2014/0015730 | A1 | 1/2014 | Anguera Pros et al. |
| 2014/0253395 | A1 | 9/2014 | Puente Baliarda et al. |
| 2014/0375521 | A1* | 12/2014 | Andujar Linares .... H01Q 1/243 343/843 |
| 2015/0022417 | A1 | 1/2015 | Pan et al. |
| 2016/0028152 | A1* | 1/2016 | Anguera Pros ..... H01Q 5/335 343/702 |
| 2016/0285166 | A1* | 9/2016 | Andujar Linares .... H01Q 1/243 |

FOREIGN PATENT DOCUMENTS

| | | | |
|---|---|---|---|
| JP | 2002223114 | A | 8/2002 |
| JP | 2005175846 | A | 6/2005 |
| JP | 2006279159 | A | 10/2006 |
| KR | 20080080409 | A | 9/2008 |
| WO | 2006020285 | A1 | 2/2006 |
| WO | 2007074369 | A1 | 7/2007 |
| WO | 2007128340 | A1 | 11/2007 |
| WO | 2008009391 | A2 | 1/2008 |
| WO | 2008119699 | A1 | 10/2008 |
| WO | 2010015364 | A2 | 2/2010 |
| WO | 2010015365 | A2 | 2/2010 |
| WO | 2011095330 | | 8/2011 |
| WO | 2012017013 | | 2/2012 |
| WO | 2014012796 | | 1/2014 |
| WO | 2014012842 | | 1/2014 |

OTHER PUBLICATIONS

Andújar, Aurora, Ground plane booster antenna technology for wireless handheld devices, PhD Dissertation, May 2013, 287 p., Barcelona-Spain, Department of Signal Theory and Communications, Universitat Politècnica de Catalunya, Technology and Intellectual Property Rights Department Fractus.

Andújar, Aurora, et al, Ground plane boosters as a compact antenna technology for wireless handheld devices, IEEE Transactions on Antennas and Propagation, May 2011, p. 1668-1677, vol. 59, No. 5.

Anguera, Jaume, et al, Advances in antenna technology for wireless handheld devices, International Journal of Antennas and Propagation, vol. 2013, 25p., Hindawi Publishing Corp.

Anguera, Jaume, et al. Advances in antenna technology for wireless handheld devices, International Journal of Antennas and Propagation, vol. 2013, 26p., Hindawi Publishing Corp.

Martínez Vázquez, M. et al, Report on the state of the art in small terminal antennas: technologies requirements and standards, Contract FP6-IST508009, Dec. 22, 2004, 120p., ACE-Antenna Centre of Excellence.

Martínez Vázquez, M., et al. Report on the state of the art in small terminal antennas: technologies requirements and standards, 2004, 119p., ACE-Antenna Centre of Excellence.

Rahola, Jussi, et al, Matching circuits speed up the design of electrically small non resonant antennas, White paper, 2014, 14p., Optenni Ltd.

Sonkki, Marko et al., Optimized dimensions of ultra wideband quasi-complementary antenna with switching capability, Proceedings of the 4th European Conference on Antennas and Propagation (EuCAP), Apr. 12-16, 2010, 4 p., IEEE, Barcelona-Spain, ISSN 2164-3342.

Villanen, Juha, Miniaturization and evaluation methods of mobile terminal antenna structures, Report S 290, Sep. 2007, 67 p., Helsinki University of Technology, Radio Laboratory Publications, Espoo-Finland, ISBN 978-951-22-8964-6.

* cited by examiner

| Total Width | Width | Gap | Char. Imp. ($Z_0$) |
|---|---|---|---|
| 2 mm | 1.5 mm | 0.5 mm | 138 Ω |
| | 1.75 mm | 0.25 mm | 108 Ω |
| | 1.8 mm | 0.2 mm | 100 Ω |
| | 1.9 mm | 0.1 mm | 81 Ω |
| 3 mm | 2.5 mm | 0.5 mm | 124 Ω |
| | 2.8 mm | 0.2 mm | 92 Ω |
| | 2.9 mm | 0.1 mm | 76 Ω |
| 4 mm | 3 mm | 1 mm | 150 Ω |
| | 3.5 mm | 0.5 mm | 116 Ω |
| | 3.8 mm | 0.2 mm | 88 Ω |
| | 3.9 mm | 0.1 mm | 72 Ω |

WIRELESS DEVICE USING AN ARRAY OF GROUND PLANE BOOSTERS FOR MULTIBAND OPERATION

CROSS REFERENCE TO RELATED APPLICATIONS

This application is a continuation of U.S. patent application Ser. No. 15/081,467 filed Mar. 25, 2016, which claims priority under 35 U.S.C. § 119(e) from U.S. Provisional Patent Application Ser. No. 62/139,809, filed Mar. 30, 2015, and claims priority under 35 U.S.C. § 119 to Application No. EP 15161245.4 filed on Mar. 27, 2015, the entire contents of which are hereby incorporated by reference.

FIELD OF THE INVENTION

The present invention relates to the field of wireless handheld devices, and generally to wireless portable devices which require the transmission and reception of electromagnetic wave signals.

BACKGROUND

Wireless electronic devices typically handle one or more cellular communication standards, and/or wireless connectivity standards, and/or broadcast standards, each standard being allocated in one or more frequency bands, and said frequency bands being contained within one or more regions of the electromagnetic spectrum.

For that purpose, a typical wireless electronic device must include a radiating system capable of operating in one or more frequency regions with an acceptable radioelectric performance (in terms of, for instance, reflection coefficient, standing wave ratio, impedance bandwidth, gain, efficiency, or radiation pattern). The integration of the radiating system within the wireless electronic device must be effective to ensure that the overall device attains good radio-electric performance (such as for example in terms of radiated power, received power, sensitivity) without being disrupted by electronic components and/or human loading.

The space within the wireless electronic device is usually limited and the radiating system has to be included in the available space. The radiating system is expected to be small to occupy as little space as possible within the device, which then allows devices to be smaller, or for the addition of more specific components and functionalities into the device. It is even more critical in the case in which the wireless device is a multifunctional wireless device, such as the ones described in commonly-owned patent applications US2014/0253395 and WO2008/009391. The entire disclosures of patent applications US2014/0253395 and WO2008/009391 are hereby incorporated by reference.

Besides radiofrequency performance, small size and reduced interaction with human body and nearby electronic components, one of the current limitations of the prior-art is that generally the antenna system is customized for every particular wireless handheld device model. The mechanical architecture of each device is different and the volume available for the antenna severely depends on the form factor of the wireless device model together with the arrangement of the multiple components embedded into the device (e.g., displays, keyboards, battery, connectors, cameras, flashes, speakers, chipsets, memory devices, etc.). As a result, the antenna within the device is mostly designed ad hoc for every model, resulting in a higher cost and a delayed time to market. In turn, as typically the design and integration of an antenna element for a radiating structure is customized for each wireless device, different form factors or platforms, or a different distribution of the functional blocks of the device will force to redesign the antenna element and its integration inside the device almost from scratch.

A radiating system for a wireless handheld or portable device typically includes a radiating structure comprising an antenna element which operates in combination with a ground plane layer providing a determined radiofrequency performance in one or more frequency regions of the electromagnetic spectrum. Typically, the antenna element has a dimension close to an integer multiple of a quarter of the wavelength at a frequency of operation of the radiating structure, so that the antenna element is at resonance or substantially close to resonance at the frequency of operation, and a radiation mode is excited on the antenna element. Due to given space limitations in the device and the necessity of providing operation in two or more frequency bands that, in some cases, are located in at least two separate frequency regions of the electromagnetic spectrum, the antenna elements usually present complex mechanical designs and considerable dimensions, mainly due to the fact that antenna performance is highly related to the electrical dimensions of the antenna element. Although the radiating structure is usually very efficient at the resonant frequency of the antenna element and maintains a similar performance within a frequency range defined around said resonant frequency (or resonant frequencies), outside said frequency range the efficiency and other relevant antenna parameters deteriorate with an increasing distance to said resonant frequency.

Some techniques for miniaturizing and/or optimizing the multiband behavior of an antenna element have been described in the prior-art. However, the radiating structures described therein still rely on exciting a radiation mode on the antenna element for each one of the frequency bands of operation.

In this sense, a radiating system such as the one described in the present invention not requiring a complex and/or large antenna formed by multiple arms, slots, apertures and/or openings and a complex mechanical design is preferable in order to minimize such undesired external effects and simplify the integration within the wireless device.

Some other attempts have focused on antenna elements not requiring a complex geometry while still providing some degree of miniaturization by using an antenna element not resonant in the one or more frequency ranges of operation of the wireless device.

For example, commonly-owned patent application WO2007/128340 discloses a wireless portable device comprising a non-resonant antenna element for receiving broadcast signals (such as, for instance, DVB-H, DMB, T-DMB or FM). The wireless portable device further comprises a ground plane layer that is used in combination with said antenna element. Although the antenna element has a first resonant frequency above the frequency range of operation of the wireless device, the antenna element is still the main responsible for the radiation process and for the radiofrequency performance of the wireless device. No radiation mode can be substantially excited on the ground plane layer because the ground plane layer is electrically short at the frequencies of operation (i.e., its dimensions are much smaller than the wavelength). For this kind of non-resonant antenna elements, a matching circuitry is added for matching the antenna to a level of SWR in a limited frequency range, which in this particular case can be around SWR≤6.

Commonly-owned patent application WO2008/119699 describes a wireless handheld or portable device comprising a radiating system capable of operating in two frequency regions. The radiating system comprises an antenna element having a resonant frequency outside said two frequency regions, and a ground plane layer. In this wireless device, while the ground plane layer contributes to enhance the electromagnetic performance of the radiating system in the two frequency regions of operation, it is still necessary to excite a radiation mode on the antenna element. In fact, the radiating system relies on the relationship between a resonant frequency of the antenna element and a resonant frequency of the ground plane layer for the radiating system to operate properly in said two frequency regions. Nevertheless, the solution still relies on an antenna element whose size is related to a resonant frequency that is outside of the two frequency regions.

In order to reduce the volume occupied in the wireless handheld or portable device as much as possible, recent trends in handset antenna design are oriented to maximize the contribution of the ground plane to the radiation process by using small non-resonant elements. However, non-resonant elements may require of complex radiofrequency systems. Thus, the challenge of these techniques mainly relies on said complexity (combination of inductors, capacitors, and transmission lines), which is required to satisfy impedance bandwidth and efficiency specifications.

Patent applications WO2010/015365 and WO2010/015364 are intended for solving some of the aforementioned drawbacks. Namely, they describe a wireless handheld or portable device comprising a radiating system including a radiating structure and a radiofrequency system. The radiating structure is formed by a ground plane layer presenting suitable dimensions as for supporting at least one efficient radiation mode and at least one radiation booster capable of coupling electromagnetic energy to said ground plane layer. The radiation booster is not resonant in any of the frequency regions of operation and, consequently, a radiofrequency system is used to properly match the radiating structure to the desired frequency bands of operation. More specifically, in WO2010/015364 each radiation booster is intended for providing operation in a particular frequency region. Thus, the radiofrequency system is designed in such a way that the first internal port associated to a first radiation booster is highly isolated from the second internal port associated to a second radiation booster. Said radiofrequency system usually comprises a matching network including resonators for each one of the frequency regions of operation and a set of filters for each one of the frequency regions of operation. Thus, said radiofrequency system requires multiple stages and the performance of the radiating systems in terms of efficiency may be affected by the additional losses of the components.

Patent applications WO2014/012796 and US2014/0015730 disclose a concentrated wireless device comprising a radiating system including a radiating structure and a radiofrequency system, such device operates two or more frequency regions of the electromagnetic spectrum. A feature of said radiating system is that the operation in at least two frequency regions is achieved by one radiation booster, or by at least two radiation boosters, or by at least one radiation booster and at least one antenna element, wherein the radiofrequency system modifies the impedance of the radiating structure, providing impedance matching to the radiating system in the at least two frequency regions of operation of the radiating system.

In patent application US2013/0342416 there is disclosed a radiating system that transmits and receives in first and second frequency regions and includes a radiating structure comprising radiation boosters, or a radiation booster and a radiating element, or radiating elements. The radiating system further includes a radiofrequency system including: first and second reactance cancellation elements providing impedances having an imaginary part close to zero for respective frequencies in the first and second frequency regions, and a delay element interconnecting the first and second reactance cancellation elements to provide a difference in phase to produce first and second impedance loops in the first and second frequency regions, respectively, at an external port. The difference in phase provides operation in at least two frequency bands, each one allocated in a different frequency region of the electromagnetic spectrum, and/or increases the number of operating frequency bands in at least one frequency region of the electromagnetic spectrum, and/or increases the number of operating frequency bands in at least two frequency regions of the electromagnetic spectrum.

Patent applications WO2014/012842 and US2014/0015728 disclose very compact, small size and light weight radiation boosters operating in single or in multiple frequency bands. Such radiation boosters are configured to be used in radiating systems that may be embedded into a wireless handheld device. Said patent applications further disclose radiation booster structures and their manufacturing methods that enable reducing the cost of both the booster and the entire wireless device embedding said booster inside the device. The entire disclosure of aforesaid application numbers WO2014/012842 and US2014/0015728 are hereby incorporated by reference.

Patent applications U.S. 62/028,494 and EP14178369 disclose a wireless device including at least one slim radiating system having a slim radiating structure and a radiofrequency system. The slim radiating structure includes one or more booster bars. The booster bar is characterized by its slim width and height factors which facilitate its integration within the wireless device and the excitation of a resonant mode in the ground plane layer, and by its location factor that enables to achieve the most favorable radio-frequency performance for the available space to allocate the booster bar. The entire disclosure of aforesaid application numbers U.S. 62/028,494 and EP14178369 are hereby incorporated by reference.

Another technique, as disclosed in U.S. Pat. No. 7,274,340, is based on the use of two coupling elements. According to the invention, quad-band operation (GSM 1800/1900 and GSM850/900 bands) is provided with two coupling elements: a low-band (LB) coupling element (for the GSM850/900 bands), and a high-band (HB) coupling element (for the GSM1800/1900 bands), where the impedance matching is provided through the addition of two matching circuits, one for the LB coupling element and another one for the HB coupling element. In spite of using non-resonant elements, the size of the element for the low band is significantly large, being 1/9.3 times the free-space wavelength of the lowest frequency for the low frequency band. Due to such size, the low band element would be a resonant element at the high band. Additionally, the operation of this solution is closely linked to the alignment of the maximum E-field intensity of the ground plane and the coupling element. The size of the low band element undesirably contributes to increase the printed circuit board (PCB) space required by the antenna module.

Therefore, a wireless device not requiring an antenna element yet providing suitable radio-frequency performance to operate in a wide range of communication bands within multiple regions of the electromagnetic spectrum would be advantageous as it would ease the integration of the radiating structure into the wireless handheld or portable device. The volume freed up by the absence of a large and complex antenna element would enable smaller and/or thinner devices, as slim electronic devices, or even to adopt radically new form factors which are not feasible today due to the presence of an antenna element featured by a considerable volume.

SUMMARY

It is an object of the present invention to provide a wireless electronic device (such as for instance but not limited to a mobile phone, a smartphone, a phablet, a tablet, a PDA, an MP3 player, a headset, a USB dongle, a GPS system, a laptop computer, a gaming device, a digital camera, a wearable device as a smart watch, a PCMCIA, Cardbus 32 card, a sensor, or generally a multifunction wireless device which combines the functionality of multiple devices) comprising a radiating system that covers a wide range of radio frequencies and handles multiple communication bands while exhibiting a suitable radio frequency performance.

Another object of the present invention is to provide a radiating system suitable for being included within electronic devices. Such radiating system advantageously comprises a radiating structure including two or more radiation boosters for the transmission and reception of electromagnetic wave signals, a radiofrequency system and an external port. Such radiating system is capable of operation in at least a first frequency region and a second frequency region of the electromagnetic spectrum; said at least first and second frequency regions are preferably separated so that the lowest frequency of the second frequency region is above (i.e., at a frequency higher than) the highest frequency of the first frequency region. The radiofrequency system comprises two or more matching networks and a combining structure at which, in transmission, electromagnetic wave signals from the external port are substantially separated and coupled to each radiation booster based on the frequency of the signals; and, in reception, signals from each radiation booster are combined and coupled to the external port. The radiofrequency system provides impedance matching to the radiating structure in said first and second frequency regions of the electromagnetic spectrum at the external port. An associated advantage of such radiating system is that signals from the first and second frequency regions are fed to (i.e., in transmission) and retrieved (i.e., in reception) in one single port (i.e., the external port).

It is also an object of the present invention to provide a radiofrequency system that comprises transmission lines particularly convenient for interconnecting one or more radiation boosters with radiofrequency front-end modules or chips when the radiation boosters are located substantially proximate to the edges of a printed circuit board. In radiating structures including two or more radiation boosters, each one of the radiation boosters may be substantially in charge of the transmission and/reception of electromagnetic wave signals of one particular frequency region, and such transmission lines together with other components of the matching networks may be advantageously configured to present, at the combining structure, an impedance relatively close to the reference impedance (generally between 12Ω and 200Ω when the reference impedance is 50Ω) at the port coupled to the radiation booster operating signals from said frequency region, and further configured to present a high impedance at the port/s of the other radiation booster/s (generally above 200Ω, such as 300Ω, 400Ω, 500Ω or even higher than 500Ω). This is especially advantageous for simplifying the radiofrequency system as the matching networks require fewer components for providing impedance matching in the two or more frequency regions of operation.

Although the present invention refers to radiating systems comprising radiation boosters, antenna systems comprising one or more radiating elements may also take advantage of such transmission lines, particularly in those cases in which at least one radiating element is substantially close to the edges of the electronic device. This is generally so due to the fact that there is a reduced amount of free space in the printed circuit boards where circuitry and components of the device are installed, and thus connection between the radiating elements and the RF front-end modules is not simple. This may be solved with the transmission lines disclosed in the present invention.

An advantageous aspect of the present invention is that the lengths of the transmission lines may be adjusted while the radiofrequency system still provides said substantial filtering behavior in the signal paths that couple the radiation boosters to the combining structure. In prior art solutions configured to operate in at least two frequency regions and in which delay elements are included for generating a difference in phase, adjusting the length (e.g., the delay) of said delay elements requires taking into consideration the impedances of the two or more radiation boosters or radiating elements. In contrast, in the present invention, adjusting the length of one transmission line mainly depends on the total impedance of the respective radiation booster and the matching network associated to said radiation booster, thus each radiation booster being more independent from the others.

An aspect of the present invention relates to the use of the ground plane layer of the radiating system as a main source of radiation. The radiation boosters of a radiating system advantageously couple the electromagnetic energy from the radiofrequency system to the ground plane layer in transmission, and from the ground plane layer to the radiofrequency system in reception. Said radiation boosters excite a radiation mode in the ground plane layer enabling the radiation from the ground plane layer.

The radiation boosters, as shown herein, are configured to be used in radiating systems according to the present invention and may be any of the radiation boosters disclosed in patent applications U.S.2014/0015728 and WO2014/012842, or booster bars disclosed in patent applications U.S. 62/028,494 and EP14178369. A radiating structure from the present invention comprises radiation boosters that fit in an imaginary sphere having a diameter smaller than ⅓ of a radiansphere corresponding to the lowest frequency of the first frequency region of the radiating system. In some cases, the radiation boosters also fit in an imaginary sphere having a diameter smaller than ¼, or preferably smaller than ⅙, or even more preferably smaller than 1/10 of a radiansphere corresponding to said frequency. The radiansphere is defined as an imaginary sphere having a radius equal to the operating wavelength divided by two times π (pi). In some embodiments, the radiation booster may have a maximum size at least smaller than 1/15 of the free-space wavelength corresponding to the lowest frequency of the first frequency region of the radiating system. In some embodiments, the maximum size of a radiation booster is at least smaller than 1/20, and/or 1/30, and/or 1/50, and/or 1/100 of the free-space wavelength corresponding to the lowest frequency of the first frequency region of operation. In some of these examples, the radiation booster has a maximum size larger than 1/1400, 1/700, 1/350, 1/250, 1/180, 1/140, or 1/120 times the free-space wavelength corresponding to the lowest frequency of the first frequency region of the radiating system. Thus in some examples, a radiation booster has a maximum size advantageously smaller than a first fraction of the free-space wavelength corresponding to the lowest frequency of the first frequency region but larger than a second fraction of said free-space wavelength.

Accordingly, the maximum size of a radiation booster is defined by the largest dimension of a booster box that completely encloses said radiation booster, and in which the radiation booster is inscribed. More specifically, a booster box for a radiation booster is defined as being the minimum-sized parallelepiped of square or rectangular faces that completely encloses the radiation booster and wherein each one of the faces of said minimum-sized parallelepiped is tangent to at least a point of said radiation booster. Moreover, each possible pair of faces of said minimum-size parallelepiped sharing an edge forms an inner angle of 90°. For each of the radiation boosters included in a radiating structure a different booster box is defined. In some examples, one of the dimensions of a booster box can be substantially smaller than any of the other two dimensions, or even be close to zero. In such cases, said booster box collapses to a practically two-dimensional entity. The term dimension refers to an edge between two faces of said parallelepiped.

In some preferred examples, the area defined by the two largest dimensions of a booster box is advantageously small compared to the square of the wavelength corresponding to the lowest frequency of the first frequency region; in particular, a ratio between said area and the square of the wavelength corresponding to the lowest frequency of the first frequency region may be advantageously smaller than at least one of the following percentages: 0.15%, 0.12%, 0.10%, 0.08%, 0.06%, 0.04%, or even 0.02%. In some of these examples, a ratio between the area defined by the two largest dimensions of a booster box and the square of the wavelength corresponding to the lowest frequency of the second frequency region may also be advantageously smaller than at least one of the following percentages: 0.50%, 0.45%, 0.40%, 0.35%, 0.30%, 0.25%, 0.20%, 0.15%, 0.10%, or even 0.05%.

Moreover, in some embodiments according to the present invention, each one of the radiation boosters entirely fits inside a limiting volume equal or smaller than $L^3/25000$, and in some cases smaller than $L^3/50000$, and/or $L^3/100000$, and/or $L^3/150000$, and/or $L^3/200000$, and/or $L^3/300000$, and/or $L^3/400000$, and/or even smaller than $L^3/500000$, being L the wavelength corresponding to the lowest frequency of the first frequency region.

The radiation boosters may include one or more booster elements. Each booster element may include a dielectric material, and in some embodiments, a single standard layer of dielectric material spacing two or more conductive elements of the booster element. A booster element may be formed by printing or depositing conductive material in a first surface and a second surface of the dielectric material (for instance, two opposed sides such as the top and the bottom ones) and adding several vias to electrically connect the conductive material in the first surface with the conductive material in the second surface. In some preferred examples, the conductive material in each of the first and second surface of a booster element has a substantially polygonal shape. Some possible polygonal shapes are, for instance but not limited to, squares, rectangles, and trapezoids. In some embodiments in which a radiation booster includes a plurality of booster elements, said booster elements are electrically connected one to each other.

Each radiation booster may be separated from the ground plane layer by a gap. In the context of this document, the gap characterizing a radiation booster refers to a minimum distance between a point at an edge of the ground plane layer and a point at an edge of the bottom conductive surface of the radiation booster. The location of the radiation booster is characterized by a location factor that is a ratio between the width of the radiation booster and said gap. In a preferred example in which the radiation boosters are located beyond an edge of the ground plane layer, the location factor is between 0.3 and 3.5.

In a preferred example, a radiating structure is arranged within a wireless handheld or portable device in such a manner that the radiation boosters are attached to (e.g., soldered to or attached by other means as known in the art) conductive elements or traces on a printed circuit board. In said preferred example, there is no ground plane in the orthogonal projections of the radiation boosters onto the plane containing the ground plane layer which, for example, may be formed in a layer of the printed circuit board. In other words, the orthogonal projections of said radiation boosters onto said plane has no area overlapping the ground plane layer. In some other cases, there may be at least partial overlapping between the orthogonal projection of one or more radiation boosters and the ground plane layer.

In some embodiments, a radiating structure may comprise more than one ground plane layer, like for instance two, three or even more ground plane layers or conductive materials acting as the ground plane for the radiating structure. In such embodiments, some or all ground plane layers may be electrically interconnected one to each other.

A preferred embodiment of the present invention relates to a wireless handheld or portable device comprising a radiating system configured to operate electromagnetic wave signals from a first frequency region and a second frequency region, wherein the lowest frequency of the second frequency region is above the highest frequency of the first frequency region. The radiating system comprises a radiating structure, a radiofrequency system and an external port. The radiating structure comprises: a printed circuit board including a ground plane layer; a first radiation booster connected to a first feeding line, a second radiation booster connected to a second feeding line, wherein each of the first and second radiation boosters fits in an imaginary sphere having a diameter smaller than 1/3 of a radiansphere having a radius equal to a free-space wavelength corresponding to the lowest frequency of the first frequency region, divided by two times π(pi); a first internal port defined between a connection point of the first radiation booster and a first connection point of the ground plane layer, and a second internal port defined between a connection point of the second radiation booster and a second connection point of the ground plane layer. The radiofrequency system comprises: a combining structure; a first matching network; a second matching network; and a third matching network. The first matching network is connected to the first feeding line and the combining structure, the first matching network comprising at least a first transmission line. The second matching network is connected to the second feeding line and the combining structure, the second matching network comprising at least a second transmission line. The third matching network is connected to the combining structure and to the external port.

In said preferred embodiment, the input impedance of the radiating structure at the first internal port, when disconnected from the radiofrequency system, has an imaginary part not equal to zero for any frequency of the first frequency region; the input impedance of the radiating structure at the second internal port, when disconnected from the radiofrequency system, has an imaginary part not equal to zero for any frequency of the first frequency region. The radiofrequency system modifies the impedance of the radiating structure to provide impedance matching to the radiating system within the first and second frequency regions at the external port.

In some cases, the input impedance of the radiating structure at the first internal port, when disconnected from the radiofrequency system, has an imaginary part not equal to zero for any frequency of the first and second frequency regions; and the input impedance of the radiating structure at the second internal port, when disconnected from the radiofrequency system, has an imaginary part not equal to zero for any frequency of the first and second frequency regions.

Each of the at least first and second transmission lines in the first and second matching networks, respectively, is characterized by one edge being substantially close to the ground plane layer. Each of the at least first and second transmission lines is characterized by a width at least 2.5 times greater than a gap separating each of the at least first and second transmission lines and the ground plane layer.

A radiating system according to the present invention may be configured to transmit and receive signals in frequency bands like for example, but not limited to: LTE700 (698-798 MHz), LTE800 (791-862 MHz), GSM850 (824-894 MHz), GSM900 (880-960 MHz), GSM1800 (1710-1880 MHz), GSM1900 (1850-1990 MHz), WCDMA2100 (1920-2170 MHz), CDMA1700 (1710-2155 MHz), LTE2300 (2300-2400 MHz), LTE2600 (2500-2690 MHz), LTE3500 (3.4-3.6 GHz), LTE3700 (3.6-3.8 GHz), WiFi (2.4-2.5 GHz and/or 4.9-5.9 GHz), etc. Such radiating systems may operate five, six, seven, eight, nine, ten or even more frequency bands.

In the context of this document, a frequency band preferably refers to a range of frequencies used by a particular cellular communication standard, a wireless connectivity standard or a broadcast standard; while a frequency region preferably refers to a continuum of frequencies of the electromagnetic spectrum. For example, the GSM1800 standard is allocated in a frequency band from 1710 MHz to 1880 MHz while the GSM1900 standard is allocated in a frequency band from 1850 MHz to 1990 MHz. A wireless device operating the GSM1800 and the GSM1900 standards must have a radiating system capable of operating in a frequency region from 1710 MHz to 1990 MHz. As another example, a wireless device operating the GSM850 standard (allocated in a frequency band from 824 MHz to 894 MHz) and the GSM1800 standard must have a radiating system capable of operating in two separate frequency regions.

In some embodiments, a ratio between the lowest frequency of the second frequency region and the lowest frequency of the first frequency region is greater than 1.5. In some other embodiments, said ratio may be greater than 1.8, or 2.0, or 2.2, or even greater than 2.4. In some of these embodiments, a ratio between the lowest frequency of the second frequency and the highest frequency of the first frequency region may be greater than 1.2, or 1.5, or 1.8, or 2.0, or 2.2, or even greater than 2.4.

Moreover, a radiating system according to the present invention may advantageously feature an impedance bandwidth in the first frequency region larger than 5%, or 10%, or 15%, or even larger than 20%. In addition, such radiating system may also feature an impedance bandwidth in the second frequency region larger than 5%, or 10%, or 15%, or 20%, or 25%, or 30%, or 35%, or even larger than 40%. The impedance bandwidth is defined as the difference between the highest and lowest frequencies of a frequency region, divided by the central frequency of that frequency region.

A radiating structure according to the present invention, when disconnected from the radiofrequency system, may feature at one, some or all of the internal ports a first resonant frequency at a frequency higher than the highest frequency of the first frequency region. The input impedance of the radiating structure measured at said internal port/s (in absence of a radiofrequency system connected to it) may have an important reactance within the frequencies of said first frequency region. In this case, a ratio between said first resonant frequency of the radiating structure measured at said internal port/s (when disconnected from the radiofrequency system) and the highest frequency of the first frequency region is advantageously greater than 1.2. In some cases, said ratio may be even greater than 1.5, 1.8, 2.0, 2.2, 2.4, 2.6, 2.8, or 3.0. In some examples, a ratio between said first resonant frequency of the radiating structure measured at said internal port/s (in absence of a radiofrequency system connected to it) and the lowest frequency of the first frequency region is advantageously greater than 1.3, or even greater than 1.4, 1.5, 1.8, 2.0, 2.2, 2.4, 2.6, 2.8, or 3.0.

In some embodiments, the first resonant frequency of the radiating structure, measured at its internal port when disconnected from the radiofrequency system, is above the highest frequency of the second frequency region, wherein a ratio between said first resonant frequency and said highest frequency of the second frequency region may be larger than 1.0, 1.1, 1.2, 1.4, 1.6, 1.8, or 2.0. In some other embodiments, said first resonant frequency is within the second frequency region. In some other examples, said first resonant frequency is above the highest frequency of the first frequency region and below the lowest frequency of the second frequency region.

In the context of this document, a resonant frequency associated to an internal port of the radiating structure preferably refers to a frequency at which the input impedance of the radiating structure, the impedance being measured at said internal port, when disconnected from the radiofrequency system, has an imaginary part equal, or substantially equal, to zero.

A radiofrequency system according to the invention comprises two or more matching circuits with one, two, three, four, or more stages each, with each stage comprising one or more circuit components (such as for example, but not limited to, inductors, capacitors, resistors, jumpers, short-circuits, transmission lines, or other reactive or resistive components). A stage can be connected in series or in parallel to other stages and/or to one of the at least one port of the radiofrequency system. In some examples, the matching networks may alternate stages connected in series (i.e., cascaded) with stages connected in parallel (i.e., shunted), forming a ladder structure, or an L-shaped structure (i.e., series-parallel or parallel-series), or a pi-shaped structure (i.e., parallel-series-parallel) or a T-shaped structure (i.e., series-parallel-series). A stage may also substantially behave as a resonant circuit (such as, for instance, a parallel LC resonant circuit or a series LC resonant circuit) in at least one frequency region of operation of the radiating system (such as for instance in the first or second frequency region).

Some or all of the matching networks advantageously comprise, in at least one of their stages, a transmission line as set forth in the present invention. By means of said transmission line and, in some embodiments, together with other stages from said matching networks, a filtering effect may be provided to each signal path between one radiation booster and the combining structure.

According to the present invention, some preferred matching circuits comprise three, four, five or six components.

As such, an advantageous aspect of radiofrequency systems according the present invention is their efficiency in that impedance matching in the first and second frequency regions may be provided with matching networks comprising reduced numbers of components, which consequently introduces lower losses in the radiofrequency system and makes it more robust against the tolerances of the components.

Particularly, the use of transmission lines configured to substantially block electromagnetic wave signals of part or the totality of the frequencies from the first or second frequency region further improves independence in the design of the first matching network from the second matching network. The characteristic impedances Z0 of the transmission lines used in the matching networks as disclosed in the present invention are usually greater than 50Ω. The impedance varies based on the width of the transmission line and the gap separating said line from the ground plane layer. Given particular width and gap values for the transmission lines of a radiofrequency system, the correct adjustment of the lengths of the transmission lines may effectively block signals from one or the other frequency region, in addition to other components from the matching networks that may contribute to blocking said signals too.

A radiofrequency system according to the present invention comprises first and second matching networks, wherein each matching network comprises a transmission line with a total width (i.e., sum of the width and the gap dimensions) that is equal or less than 4 mm, preferably less than 3 mm, and more preferably substantially equal to 2 mm.

For those embodiments in which the total width of each of the transmission lines is substantially 2 mm, it is considered that 1.5 mm-wide lines separated 0.5 mm from the ground plane layer set a convenient trade-off between the characteristic impedance and the tolerances of standard PCB manufacturing techniques for mass production. The lengths of the lines have to be adjusted properly, yet certain deviations from the nominal width and gap values are expected due to fabrication inaccuracies, with the performance of the radiating system having to be kept more or less similar. Such pair of values may be different in other embodiments, wherein similar or different total widths of the transmission lines and with the lengths of the lines being modified accordingly.

A further aspect of the present invention relates to a test platform for electromagnetically characterizing booster elements. Said platform comprises a substantially square conductive surface on top of which, and substantially close to the central point, the element to be characterized is mounted perpendicular to said surface in a monopole configuration, said conductive surface acting as the ground plane.

The substantially square conductive surface comprises sides with a dimension larger than a reference operating wavelength. In the context of the present invention, said reference operating wavelength is the free-space wavelength equivalent to a frequency of 900 MHz. A substantially square conductive surface according to the present invention is made of cupper with sides measuring 60 centimeters, and a thickness of 0.5 millimeters.

In the test configuration as set forth above, a booster element according to the present invention is characterized by a ratio between the first resonance frequency and the reference frequency (900 MHz) being larger than a minimum ratio of 3.0. In some cases, said ratio may be even larger than a minimum ratio such as: 3.4, 3.8, 4.0, 4.2, 4.4, 4.6, 4.8, 5.0, 5.2, 5.4, 5.6, 5.8, 6.0, 6.2, 6.6 or 7.0.

A booster element according to the present invention may also be characterized by a radiation efficiency measured in said platform, at a frequency equal to 900 MHz, being less than 50%, preferably being less than 40%, 30%, 20%, or 10%, and in some cases being less than 7.5%, 5%, or 2.5%. All those are quite remarkably low efficiency values considering the additional 1:3 frequency mismatch and beyond obtained in some of the embodiments as described above. Such a frequency shift would introduce further mismatch losses that would result in an overall antenna efficiency below 5%, and quite typically below 2%, which would be ordinarily considered unacceptable for a mobile phone or wireless application. Still, quite surprisingly, when combining one or more of such a low efficiency booster elements with the radiofrequency system within the radiating system of a wireless device according to the present invention, said radiating system recovers the efficiency required for the performance of a typical wireless device.

In some embodiments, a radiation booster according to the present invention may also be characterized with said platform comprising the substantially square conductive surface. In these embodiments, a radiation booster may feature a ratio between the first resonance frequency and the reference frequency is larger than one, some or all of the aforementioned minimum ratios. Moreover, a radiation booster in some cases may also be characterized by a radiation efficiency measured in said platform, at a frequency equal to 900 MHz, being less than 50%, preferably being less than 40%, 30%, 20%, or 10%, and even more preferably being less than 7.5%, 5%, or 2.5%.

BRIEF DESCRIPTION OF THE DRAWINGS

Further characteristics and advantages of the invention will become apparent in view of the detailed description which follows of some preferred embodiments of the invention given for purposes of illustration only and in no way meant as a definition of the limits of the invention, made with reference to the accompanying drawings.

FIG. 4A shows an exemplary matching network comprising a transmission line; and FIG. 4B shows an exemplary matching network suitable for interconnection between the combining structure and the external port of a radiating system.

DETAILED DESCRIPTION

Figure 1:
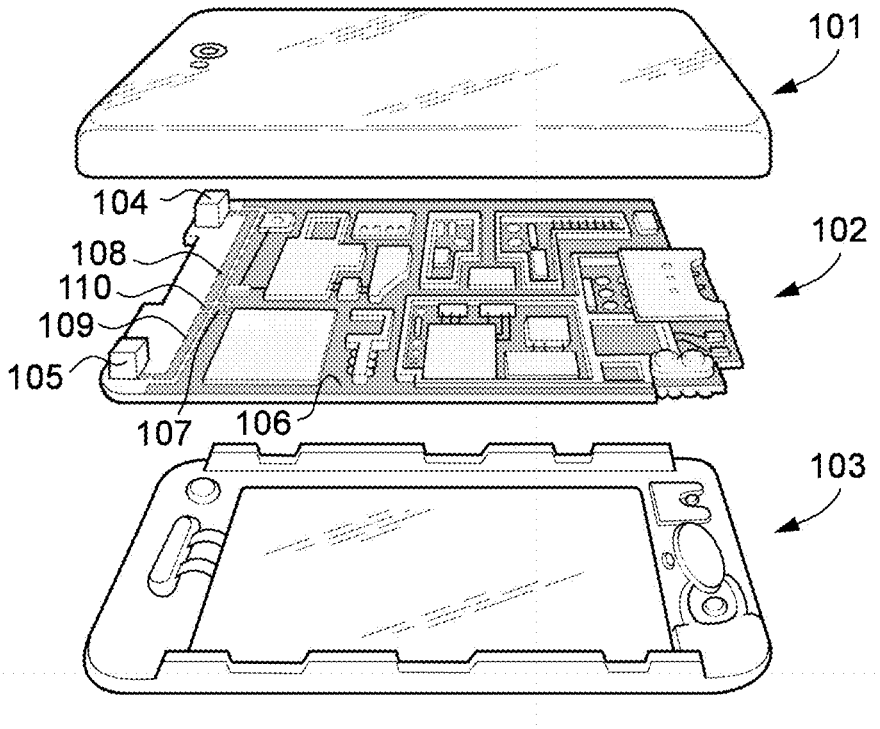
FIG. 1 shows a wireless handheld device, in an exploded view, comprising an exemplary radiating system.
Figure 5:
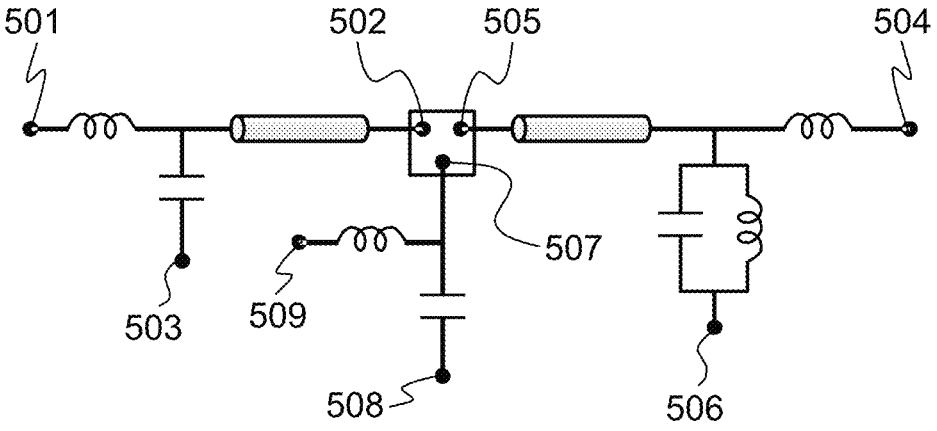
FIG. 5 shows, in a block diagram fashion, an example of a radiofrequency system according to the present invention.

In FIG. 1 there is shown a mobile phone in an exploded view, the phone including parts 101, 102, and 103. The mobile phone comprises an exemplary radiating system according to the present invention. The radiating system comprises a radiating structure included in the printed circuit board 102 comprising first radiation booster 104, second radiation booster 105, and ground plane layer 106. The radiating system further comprises the external port 107, and a radiofrequency system which, for clarity, is shown with no components in the matching networks other than first transmission line 108, second transmission line 109, and a combining structure taking the form of conductive pad 110. An example of a complete radiofrequency system is shown in FIG. 5.

Although the device from FIG. 1 is a mobile phone, other wireless handheld or portable devices may include a similar radiating system.

Figure 2:
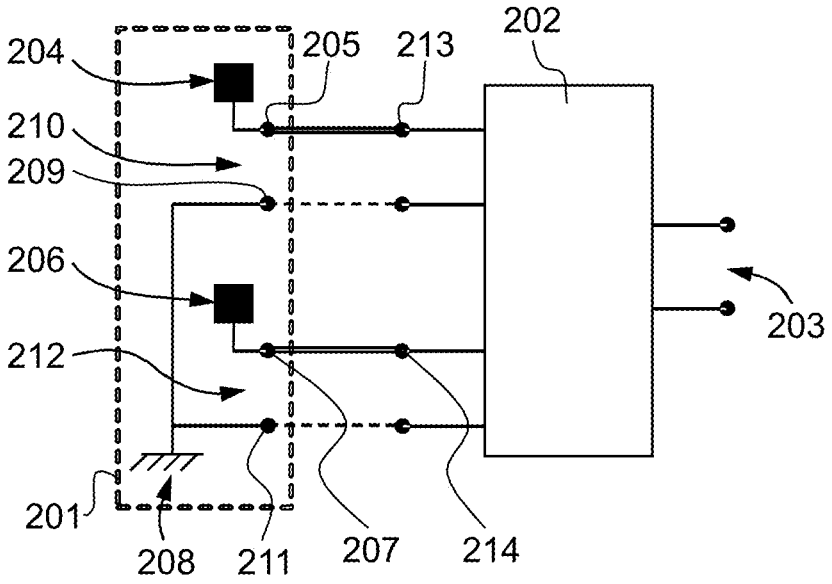
FIG. 2 shows schematically a radiating system according to the present invention.

A radiating system according to the present invention is shown schematically in FIG. 2. Said radiating system comprises the radiating structure 201, the radiofrequency system 202, and the external port 203. The radiating structure includes the first radiation booster 204 with a connection point 205, the second radiation booster 206 with a connection point 207, and a ground plane 208 with connection points 209 and 211. A first internal port 210 is defined between the connection point 205 of radiation booster 204 and the connection point 209 of the ground plane 208, and a second internal port 212 is defined between the connection point 207 of radiation booster 206 and the connection point 211 of the ground plane 209. The first radiation booster is connected to a first feeding line through connection point 205, and the second radiation booster is connected to a second feeding line through connection point 207. The radiofrequency system 202 is connected to said first and second feeding lines through connection points 213 and 214 of the feeding lines, and is also connected to the external port 203. The radiofrequency system provides impedance matching to the radiating structure 201 at the external port 203 so that the radiating system is configured to operate electromagnetic wave signals from first and second frequency regions of the electromagnetic spectrum.

The ground plane 208 may be, for instance, a layer of a printed circuit board acting precisely as a ground plane. It may also be formed in more than one layer of a printed circuit board, with several layers being electrically connected; or even be formed in more than one printed circuit board, with the ground plane layers being interconnected.

Figure 3A:
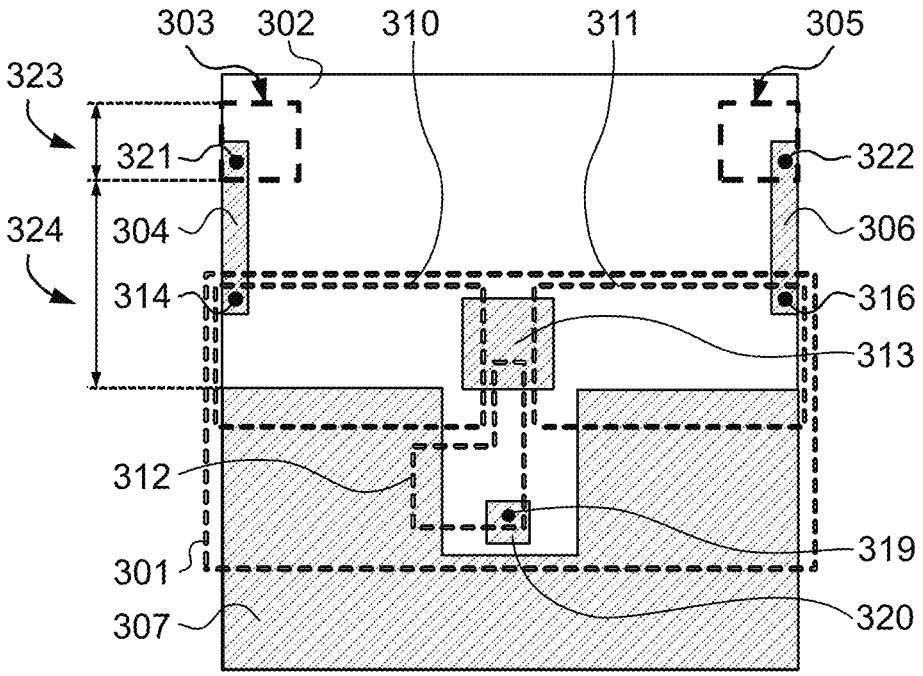
FIG. 3A and FIG. 3B show exemplary radiating systems with diagrammatic representations of radiofrequency systems.

A radiating system with a schematic radiofrequency system 301 is shown in FIG. 3A. The printed circuit board 302 includes a radiating structure comprising first radiation booster 303 which includes connection point 321 in electrical contact with first feeding line 304 in the form of a conductive trace, second radiation booster 305 which includes connection point 322 in electrical contact with second feeding line 306 in the form of a conductive trace, and a ground plane layer 307 comprising one or more connection points.

The radiofrequency system 301 comprises first matching network 310, second matching network 311, third matching network 312 (matching networks 310, 311 and 312 are shown empty for illustrative purposes only) and combining structure 313 which in this particular example is formed as a conductive pad on the printed circuit board 302. The first matching network is defined between point 314 in the first conductive trace 304 and the combining structure 313, the second matching network is defined between point 316 in the second conductive trace 306 and the combining structure 313, and the third matching network is defined between the combining structure and conductive pad 320. In this example, the external port 319 of the radiating system is defined between conductive pad 320 and the ground plane layer 307. Generally, the matching networks 310, 311, 312 may also be connected to the ground plane 307.

In FIG. 3A there are also shown the width 323 and gap 324 dimensions characterizing radiation booster 303, wherein gap 324 represents the minimum distance of an edge of the conductive part of the radiation booster connected to the conductive trace 304 to the ground plane layer 307, and wherein width 323, in the context of this invention, is taken as the smallest dimension of the radiation booster's footprint on the printed circuit board 302. The ratio between width 323 and gap 324 defines the location factor of the radiation booster. The location factor is preferably greater than 0.3, and/or 0.5, and/or 1.0, and is preferably smaller than 3.5, and/or 3.0, and/or 2.5, and/or 2.0.

Figure 4A:
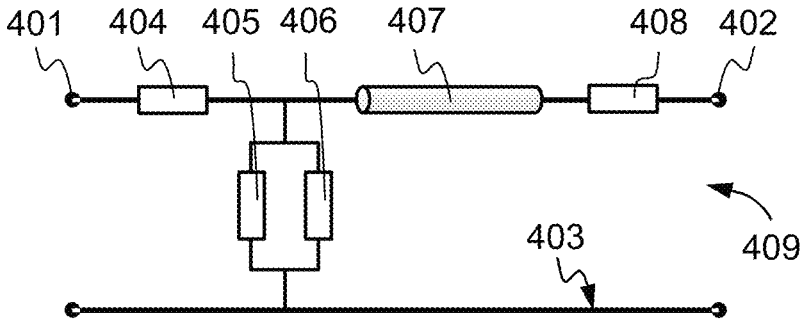
FIG. 4A and FIG. 4B schematically show examples of matching networks for a radiofrequency system according to the present invention. More particularly.
Figure 4B:
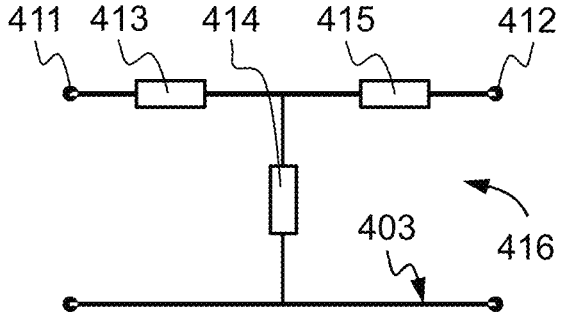

In FIG. 3A, the matching networks 310, 311, 312 do not include any component for illustrative purposes only. An example of a suitable matching network for any of the first and second matching networks 310, 311 is shown in FIG. 4A, and an example of a matching network that may be added as the third matching network 312 is depicted in FIG. 4B.

Figure 8A:
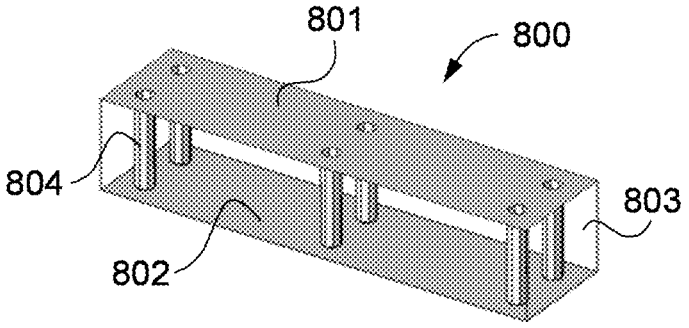
FIG. 8A and FIG. 8B show exemplary booster elements according to the present invention.
Figure 8B:
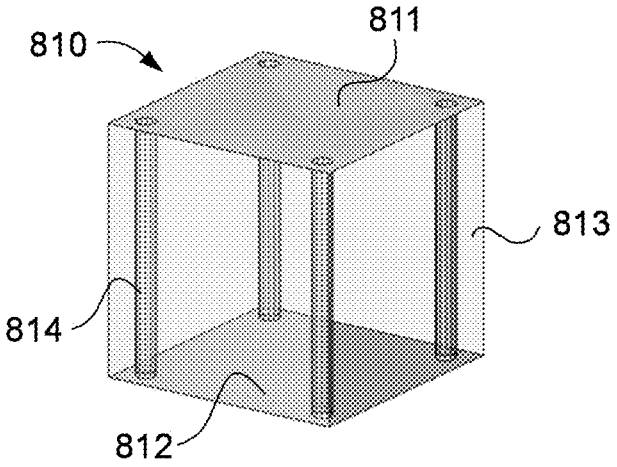

It is readily apparent to the person skilled in the art that radiation boosters 303 and 305 may comprise a booster element like in the form of booster elements 800 and 810 of FIGS. 8A and 8B, or take any other form including the combination of more than one booster element. Therefore the radiation boosters are not limited to the form of polygons 303 and 305 (drawn with dashed lines) of FIG. 3A.

Figure 3B:
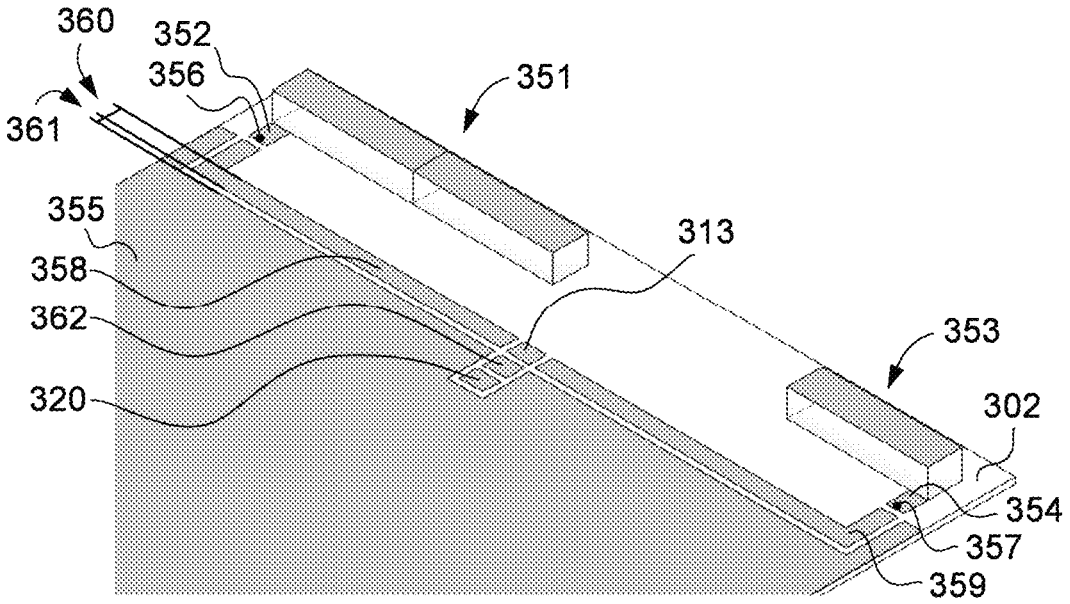

FIG. 3B also shows a radiating system wherein the radiating structure comprises first radiation booster 351 formed by two booster elements, said radiation booster fits in an imaginary sphere having a diameter smaller than ⅓ of a radiansphere corresponding to the lowest frequency of the first frequency region of the radiating system. The radiation booster 351 is connected to conductive trace 352. The radiating structure further comprises second radiation booster 353 formed by one booster element, and it is connected to conductive trace 354 of the printed circuit board 302. Conductive traces 352 and 354 advantageously separate radiation boosters 351 and 353, respectively, from the ground plane layer 355; said separation may improve the performance of the radiation boosters in terms of impedance bandwidth, and/or efficiency, and/or reflection coefficient. In preferred embodiments, the location factor of radiation boosters is at least 0.3 and less than 3.5, wherein said location factor is defined as the ratio between the width of the radiation booster and the separation between the radiation booster and the ground plane layer.

In the context of the present invention, a first matching network is defined between point 356 in trace 352 and a point in the combining structure 313, a second matching network is defined between point 357 in trace 354 and a point in the combining structure 313, and a third matching network is defined between a point in the combining structure 313 and a point in pad 320, wherein said pad 320 may further define the external port 319 of the radiating system as shown in FIG. 3A. In some cases, a bandwidth target may be achieved at the combining structure and the third matching network may not be necessary, in which case it is also possible that the external port of the radiating system may be defined between the combining structure 313 and the ground plane layer 355.

The first matching network, in addition to other components not drawn in FIG. 3B but shown in FIG. 4A and FIG. 5, comprises a first transmission line 358 characterized by width 360, gap or separation 361 from the ground plane layer 355, and a length. The second matching network, which also comprises other components not represented in FIG. 3B but shown in FIG. 4A and FIG. 5, includes a second transmission line 359 that is also characterized by a width, a gap from the ground plane layer 355, and a length. In this embodiment, both transmission lines 358 and 359 feature the same width 360 and gap 361. The correct election of the lengths of the transmission lines, depending on the given width 360 and gap 361 values, and together with the rest of the components from the respective matching networks, makes the impedance measured at the combining structure 313 towards the first radiation booster 351 to be particularly high for some or all frequencies of the one frequency region (e.g., the second frequency region), and the impedance measured at the combining structure 313 towards the second radiation booster 351 to be particularly high for some or all frequencies of the other frequency region (e.g., the first frequency region). The first and second matching networks also provide impedance matching to frequencies for which the input impedance at the combining structure is not high, namely the frequencies from the other one of the first and second frequency regions. In those cases in which said impedance matching does not achieve a bandwidth target in one or both frequency regions, the third matching network further tunes the impedance for the combined electromagnetic wave signals so as to achieve said bandwidth target; conductive pad 362 may be convenient for allocating part of said third matching network. A circuit that may be suitable for the third matching network may be seen in FIG. 4B and FIG. 5.

A particularity of transmission lines 358 and 359 is that there is no ground plane near the edge of the transmission lines that is closer to radiation boosters 351 and 353, and ground plane is mainly present at the opposite side (the side defining gap 361). Generally, almost no ground plane is present at one side of the transmission lines. In less preferred embodiments, there may be a ground plane layer substantially beneath the transmission lines, such as a layer of a multilayer printed circuit board that may be below said lines. In addition, and even though the lengths of transmission lines 358 and 359 in FIG. 3B is substantially similar, in other embodiments the length of the first transmission line may be different to the length of the second transmission line.

A matching circuit as represented in FIG. 4A may be used in any of the first and second matching networks of a radiofrequency system according to the present invention. Although a particular topology is shown, other topologies may also be used as long as one of the components in the matching network is a transmission line as disclosed in the present invention. In this particular example, point 401 is to be connected to a feeding line such as 352 or 354 in FIG. 3B (corresponding either to point 356 or 357 for example), and point 402 is to be connected to the combining structure like 313 in FIG. 3A or FIG. 3B. In this particular case, the matching circuit comprises four stages: the first stage includes series component 404, the second stage includes two shunted components 405 and 406 which are connected to a ground plane 403, the third stage comprises transmission line 407, and the fourth stage comprises component 408 connected in series between transmission line 407 and point 402. In other embodiments, such a matching circuit may comprise less than four stages or more than four stages.

The matching network is advantageously configured so that the input impedance measured at port 409 is high for part or the totality of the frequencies comprised in one of the first and second frequency regions, thus substantially blocking electromagnetic wave signals from said frequency region, whereas impedance matching at port 409 is partial or total for the other one of said first and second frequency regions.

Regarding FIG. 4B, an exemplary matching circuit suitable for the third matching network of a radiofrequency system is depicted. In this particular circuit, point 411 is connected to the combining structure such as 313 in FIG. 3A or FIG. 3B, and point 412 connects to a pad (such as 320 in FIG. 3A or FIG. 3B) that also defines the external port of the radiating system. The matching circuit comprises three stages, but in other examples it may comprise one, two, or more than three stages. The first stage corresponds to component 413 in series, the component 414 from the second stage is in parallel and connected to ground plane 403, and third stage comprises component 415 also in series. The input impedance or the reflection coefficient achieves a bandwidth target when measured at port 416.

All the circuit components from FIGS. 4A-4B other than the transmission lines may be any of the following, but not limited to: inductors, capacitors, resistors, jumpers, short-circuits, transmission lines, or other reactive or resistive components. The combination of components and topologies of the matching networks depend on the particular characteristics of the radiating system like, for example: the frequency regions of operation of the radiating system; the radiation boosters used and their location in the wireless device; the lengths and shapes of the conductive traces; the dimensions and shapes of the ground plane layers; the width, length and gap parameters of the transmission lines; the electronics and circuitry of the device that are nearby the radiating structure, etc.

FIG. 5 depicts an illustrative example of a radiofrequency system with the first matching network being defined between points 501 (in a first feeding line that connects to a first radiation booster), 502 (in the combining structure), and 503 (in the ground plane); the second matching network being defined between points 504 (in a second feeding line that connects to a second radiation booster), 505 (in the combining structure), and 506 (in the ground plane); and the third matching network being defined between points 507 (in the combining structure), 508 (in a conductive pad that may further define the external port of the radiating system), and 509 (in the ground plane).

Although in this specific embodiment particular matching network topologies and component combinations are represented, it will be readily apparent to the person skilled in the art that other matching networks are also possible according to the teachings of the present invention.

Figures 6, 7:
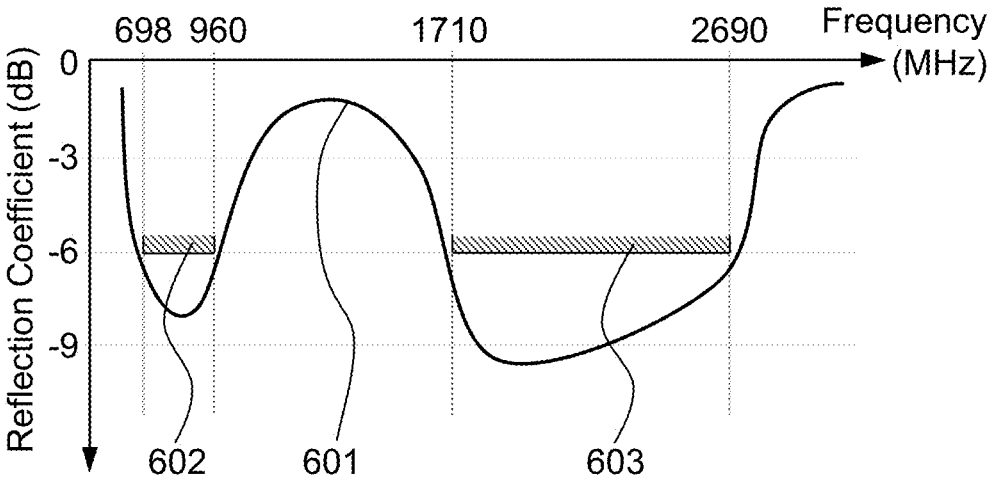
FIG. 6 shows a possible reflection coefficient measured at the external port of a radiating system which may be included in a wireless device such as FIG. 1.
FIG. 7 shows a table with several transmission line gap and width ratios and the associated characteristic impedances.

FIG. 6 is a graph representing an exemplary reflection coefficient versus frequency measured at the external port of a radiating system according to the present invention. In this particular graph, the reflection coefficient 601 is equal or lower than −6 dB in the first frequency region 602 ranging from 698 MHz to 960 MHz, and in the second frequency region 603 ranging from 1710 MHz to 2690 MHz. Such performance may be achieved, for example, by the radiating system from FIG. 3B including the radiofrequency system from FIG. 5.

In other embodiments, the reflection coefficient target may be even lower or greater like for instance −4.4 dB; and/or the first and second frequency regions may comprise ranges of frequencies different from the ones shown in FIG. 6.

A table showing pairs of width and gap values of transmission lines is represented in FIG. 7. Specifically, the characteristic impedance (Z0) is indicated for few width-gap pairs when the total width of the transmission line is 2 mm, 3 mm, and 4 mm when no ground plane layer is located beneath the transmission line, although the invention is not limited by the presence or absence of ground plane below the transmission lines.

As represented in the table, the characteristic impedance decreases as the gap is reduced. Accordingly, for given width and gap values that preferably make the transmission line to have a characteristic impedance between 75 Ωand 150Ω, the length of the transmission lines has to be set properly to make the radiating system operable in first and second frequency regions. And for the radiating system to support the tolerances in the PCB manufacturing process, gaps of about 0.5 mm are convenient as slight variations in the fabrication do not have an impact as large as in the case of gaps of 0.2 mm or even 0.1 mm. So for a preferred embodiment with transmission lines featuring a total width of 2 mm, a width of 1.5 mm and a gap of 0.5 mm advantageously make the radiating system operable in two frequency regions by adjusting the lengths of the lines.

Two exemplary booster elements are shown in FIG. 8A and FIG. 8B. The booster element 800 comprises a first conductive surface 801, a second conductive surface 802, a dielectric element or support 803 (shown transparent for illustrative purposes only), and several via holes 804 electrically connecting the first conductive surface 801 with the second conductive surface 802. The first and second conductive surfaces 801 and 802 substantially feature rectangular shapes.

The booster element 810 from FIG. 8B comprises a first conductive surface 811 and a second conductive surface 812, each of which are substantially shaped as squares, although other shapes are possible as well. Said surfaces 811 and 812 are electrically connected by via holes 814 going through the dielectric material 813.

Both booster elements 800 and 810 may be configured to function as a radiation booster in every radiating structure according to the present invention in a single configuration as radiation booster 353 of FIG. 3B, or in a multiple configuration like 351 in FIG. 3B wherein two or more booster elements are connected yet they are configured to function as a single radiation booster.

A connection point (such as 205 and 207 in FIG. 2; or 321 and 322 in FIG. 3A) of booster elements such as 800 and 810 may be located substantially close to one corner of one of the first and second conductive surfaces.

Figure 9A:
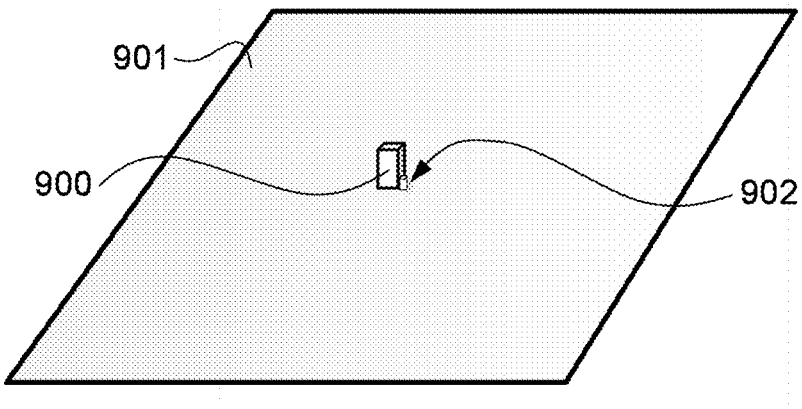
FIG. 9A and FIG. 9B show a test platform for the electromagnetic characterization of booster elements.

FIG. 9A schematically shows, in a 3D perspective, a test platform for the characterization of booster elements. The platform comprises substantially square conductive surface 901 and connector 902 (for instance an SMA connector) electrically connected to the device or element 900 to be characterized. The conductive surface 901 has sides with a length larger than the reference operating wavelength corresponding to the reference frequency. For instance, at 900 MHz, said sides are at least 60 centimeters long. The conductive surface may be a sheet or plate made of cupper, for example. The connector 902 is placed substantially in the center of conductive surface 901.

Figure 9B:
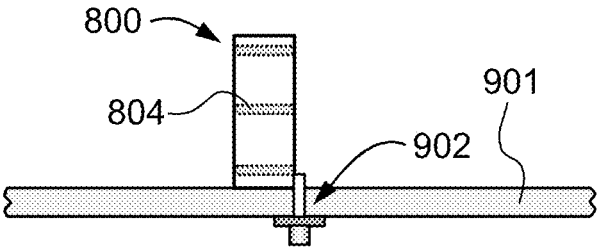

In FIG. 9B the same test platform of FIG. 9A is schematically represented in a 2D perspective wherein the conductive surface 901 is partially drawn. In this example, the element that is to be characterized 900 in FIG. 9A corresponds to booster element 800 from FIG. 8A, which is arranged so that its largest dimension is perpendicular to conductive surface 901, and one of the first or second conductive surfaces (801 or 802 of FIG. 8A) is in direct electrical contact with connector 902 (for clearer interpretation of the orientation of booster element 800, via holes 804 connecting the first and second conductive surfaces of booster element are also drawn in FIG. 9B). The booster element 800 lies on a dielectric material (not shown) attached to the conductive surface 901 so as to minimize the distance between booster element 800 and surface 901. Said dielectric material may be a dielectric tape or coating, for example.

Figure 10:
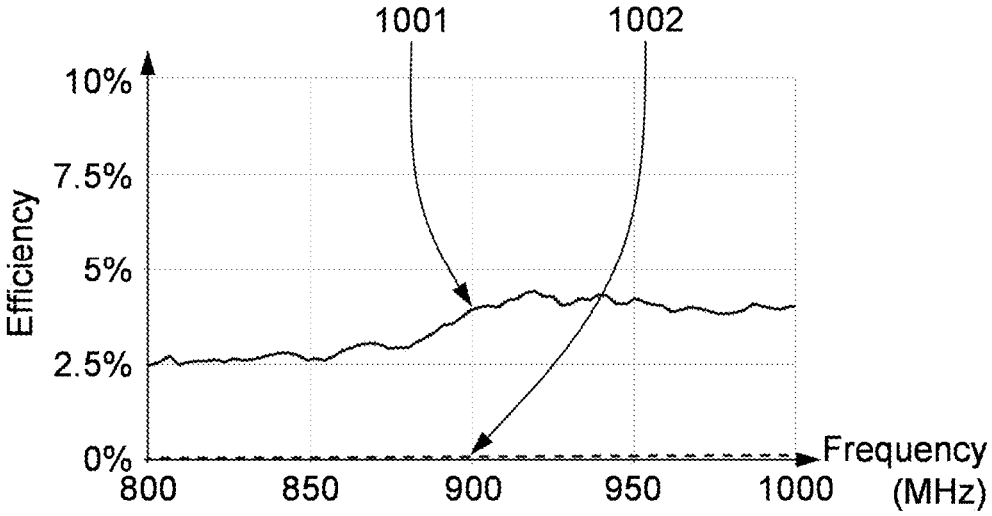
FIG. 10 shows the radiation efficiency and antenna efficiency of a booster element according to the present invention measured with the test platform depicted in FIGS. 9A-9B.

FIG. 10 shows an graph of the radiation efficiency and antenna efficiency measured in a test platform like the one shown in FIG. 9A and FIG. 9B, when the element 900 to be characterized is booster element 800. In this particular example, the radiation efficiency measured 1001 (represented with a solid line) at 900 MHz is less than 5%, and the antenna efficiency measured 1002 (represented with a dashed line) at 900 MHz is less than 1%.

The foregoing is merely illustrative of the principles of this invention and various modifications can be made by those skilled in the art without departing from the scope and spirit of the invention.

What is claimed is:

1. A radiating system configured to operate in at least a first frequency region and a second frequency region of the electromagnetic spectrum, the radiating system comprising:

an external port;

a first feeding line including first and second connection points;

a second feeding line including first and second connection points;

a radiating structure comprising:

a ground plane layer including first and second connection points;

a first radiation booster including a first booster connection point connected to the first connection point of the first feeding line, the first radiation booster being coupled to the ground player at a first internal port defined between the first booster connection point and the first connection point of the ground plane layer; and a second radiation booster including a second booster connection point connected to the first connection point of the second feeding line, the second radiation booster being coupled to the ground player at a second internal port defined between the second booster connection point and the second connection point of the ground plane layer; and a radiofrequency system to provide impedance matching to the radiating structure in the at least first and second frequency regions at the external port, the radiofrequency system comprising:

a combining structure;

a first matching network defined between the second connection point of the first feeding line and a point in the combining structure, the first matching network comprising a first transmission line having a width, a gap from the ground plane layer, and a length; and a second matching network defined between the second connection point of the second feeding line and a point in the combining structure, the second matching network comprising a second transmission line having a width, a gap from the ground plane layer, and a length.

2. The radiating system of claim 1, wherein the first and second feeding lines are conductive traces.

3. The radiating system of claim 1, wherein the radiofrequency system further comprises a third matching network defined between a point in the combining structure and the external port.

4. The radiating system of claim 1, wherein a lowest frequency of the second frequency region is higher than a highest frequency of the first frequency region such that the first and second frequency regions are separated.

5. The radiating system of claim 1, wherein the combining structure is a conductive pad.

6. The radiating system of claim 1, wherein, for each of the first and second transmission lines, the width is at least 2.5 times greater than the gap from the ground plane layer.

7. The radiating system of claim 6, wherein, for each of the first and second transmission lines, the width is equal to or greater than 1 mm and less than 3.5 mm.

8. The radiating system of claim 6, wherein, for each of the first and second transmission lines, the gap from the ground plane layer is greater than 0.1 mm and equal to or less than 1 mm.

9. The radiating system of claim 8, wherein, for each of the first and second transmission lines, the width is substantially equal to 1.5 mm and the gap from the ground plane layer is substantially equal to 0.5 mm.

10. The radiating system of claim 1, wherein, for the first and second transmission lines, the gap from the ground plane layer is located along a side of the first and second transmission line that is opposite to a side that is closer to the radiation boosters.

11. The radiating system of claim 1, wherein an impedance measured at the combining structure towards the first radiation booster is greater than 200 ohms for some or all frequencies of one of the first and second frequency regions of operation.

12. The radiating system of 11, wherein an impedance measured at the combining structure towards the second radiation booster is greater than 200 ohms for some or all frequencies of the other of the first and second frequency regions of operation.

13. The radiating system of claim 1, wherein the radiating system has an impedance bandwidth in the first frequency region greater than 10%.

14. The radiating system of claim 13, wherein the radiating system has an impedance bandwidth in the second frequency region greater than 20%.

15. A radiating system configured to operate in at least a first frequency region and a second frequency region of the electromagnetic spectrum, the radiating system comprising:

an external port;

a first feeding line including first and second connection points;

a second feeding line including first and second connection points;

a radiating structure comprising:

a ground plane layer including first and second connection points;

a first radiation booster including a first booster connection point connected to the first connection point of the first feeding line, the first radiation booster being coupled to the ground player at a first internal port defined between the first booster connection point and the first connection point of the ground plane layer; and a second radiation booster including a second booster connection point connected to the first connection point of the second feeding line, the second radiation booster being coupled to the ground player at a second internal port defined between the second booster connection point and the second connection point of the ground plane layer, wherein the first and second radiation boosters are located beyond an edge of the ground plane layer, and wherein, for each of the first and second radiation boosters, a location of the radiation booster is characterized by a location factor defined as a ratio between a width of the radiation booster and a gap that separates the radiation booster from the ground plane layer; and a radiofrequency system to provide impedance matching to the radiating structure in the at least first and second frequency regions at the external port, the radiofrequency system comprising:

a combining structure;

a first matching network defined between the second connection point of the first feeding line and a point in the combining structure, the first matching network comprising a first transmission line having a width, a gap from the ground plane layer, and a length; and a second matching network defined between the second connection point of the second feeding line and a point in the combining structure, the second matching network comprising a second transmission line having a width, a gap from the ground plane layer, and a length.

16. The radiating system of claim 15, wherein the radiofrequency system further comprises a third matching network defined between a point in the combining structure and the external port.

17. The radiating system of claim 15, wherein the location factor of the first and second radiation boosters is between 0.3 and 3.5.

18. The radiating system of claim 15, wherein, for each of the first and second transmission lines, the width is at least 2.5 times greater than the gap from the ground plane layer.

19. The radiating system of claim 15, wherein:

an impedance measured at the combining structure towards the first radiation booster is greater than 200 ohms for some or all frequencies of one of the first and second frequency regions of operation; and the impedance measured at the combining structure towards the second radiation booster is greater than 200 ohms for some or all frequencies of the other of the first and second frequency regions of operation.

20. The radiating system of claim 15, wherein the radiating system has an impedance bandwidth in the first frequency region greater than 10% and an impedance bandwidth in the second frequency region greater than 20%.

* * * * *